US010772802B2

(12) United States Patent
Radohl et al.

(10) Patent No.: US 10,772,802 B2
(45) Date of Patent: Sep. 15, 2020

(54) PILL-CUTTING DEVICE

(71) Applicants: Tami Radohl, Olathe, KS (US); Matthew Sigley, Olathe, KS (US)

(72) Inventors: Tami Radohl, Olathe, KS (US); Matthew Sigley, Olathe, KS (US)

( * ) Notice: Subject to any disclaimer, the term of this patent is extended or adjusted under 35 U.S.C. 154(b) by 0 days.

(21) Appl. No.: 16/251,330

(22) Filed: Jan. 18, 2019

(65) Prior Publication Data

US 2019/0224076 A1 Jul. 25, 2019

Related U.S. Application Data

(60) Provisional application No. 62/621,883, filed on Jan. 25, 2018.

(51) Int. Cl.
*A61J 7/00* (2006.01)
*B26D 1/08* (2006.01)
(Continued)

(52) U.S. Cl.
CPC ..... *A61J 7/0007* (2013.01); *B26D 1/08* (2013.01); *B26D 5/10* (2013.01); *B26D 7/01* (2013.01); *B26D 2210/06* (2013.01)

(58) Field of Classification Search
CPC ..... A61J 7/0007; B26D 1/08; B26D 5/10; B26D 7/10; B26D 2210/06; B23D 15/02
(Continued)

(56) References Cited

U.S. PATENT DOCUMENTS 158,205 A 12/1874 Farmer
282,155 A * 7/1883 Burns ..... B26F 1/36 83/588
(Continued)

FOREIGN PATENT DOCUMENTS

| | | |
|---|---|---|
| CN | 202409523 | 9/2012 |
| DE | 20303419 | 4/2003 |
| KR | 20110099090 | 9/2011 |

OTHER PUBLICATIONS

EDMGB, Bonsai 8" Concave Branch Cutter Pruner Japanese Gardener Tool, retrieved at https://www.amazon.com/Bonsai-Concave-Branch-Japanese-Gardener/dp/B00JLRKPC6, Jul. 27, 2018.
(Continued)

*Primary Examiner* — Andrea L Wellington
*Assistant Examiner* — Liang Dong
(74) *Attorney, Agent, or Firm* — Erise IP, P.A.

(57) ABSTRACT

A cutting device includes a first blade having a first sharp edge aligned in a first direction, and a second blade having a second sharp edge aligned in a second direction, opposite the first direction. The second blade is oriented adjacently in proximity with the first blade so that they may slide closely besides one another. The first sharp edge has a first concavely-curved indent, and the second sharp edge has a second concavely-curved indent aligned opposite the first concavely-curved indent. The first and second concavely-curved indents form an opening between the first sharp edge and the second sharp edge. The opening is adapted to receive a pill for cutting when the first blade is moved in the first direction and the second blade is concurrently moved in the second direction, which effectively splits the pill for precise dosing and reduced waste.

18 Claims, 8 Drawing Sheets

(51) Int. Cl.
*B26D 5/10* (2006.01)
*B26D 7/01* (2006.01)

(58) Field of Classification Search
USPC ..... 83/623
See application file for complete search history.

(56) References Cited

U.S. PATENT DOCUMENTS

| | | | | | |
|---|---|---|---|---|---|
| 287,589 | A | | 10/1883 | Stevens | |
| 294,034 | A | | 2/1884 | Hall | |
| 555,108 | A | | 2/1896 | Morrill | |
| 568,242 | A | | 9/1896 | Fay | |
| 854,433 | A | | 5/1907 | Rowan | |
| 987,786 | A | | 3/1911 | Adell | |
| 1,641,077 | A | | 8/1927 | Fouquet | |
| 3,461,555 | A | | 8/1969 | Bliznak | |
| 4,199,863 | A | * | 4/1980 | Deckert | A61J 7/0007 30/124 |
| 4,229,881 | A | | 10/1980 | Troxel | |
| 4,815,210 | A | * | 3/1989 | Burrage | A61B 17/282 30/176 |
| 5,157,996 | A | | 10/1992 | Keyvani | |
| 6,752,053 | B2 | | 6/2004 | Rubicam | |
| 7,673,778 | B2 | | 3/2010 | Sze | |
| 8,430,287 | B2 | | 4/2013 | Sze | |
| 8,474,674 | B2 | | 7/2013 | Sze | |
| 8,925,434 | B2 | * | 1/2015 | Omura | A61J 7/0007 83/106 |
| 9,314,405 | B2 | * | 4/2016 | Smith | A61J 7/0007 |
| 2008/0113367 | A1 | | 5/2008 | Becker et al. | |

OTHER PUBLICATIONS

BonsaiMary.com; Concave Branch Cutter the First Real Bonsai Tool to Purchanse, retrieved at https://www.bonsaimary.com/concave-branch-cutter.html, Copyright 2008-2019.

Rubberized Steel Cigar Scissors—Cigars Intl, retrieved at https://www.cigarsinternational.com/p/rubberized-steel-cigar-scissors-cutters/1514528/, Copyright 1996-2019.

Kme, Stainless Steel Top Nose Cutter Plier, Singapore Wholesale, retrived at http://koiming.com/en/tools-and-adhesives/916-stainless-steel-top-nose-cutter-plier.html, date unknown.

* cited by examiner

PILL-CUTTING DEVICE

CROSS-REFERENCE TO RELATED APPLICATIONS

This application claims the benefit of U.S. Provisional Patent Application Ser. No. 62/621,883, entitled Pill-Cutting Device and filed Jan. 25, 2018, the disclosure of which is herein incorporated by reference in its entirety.

BACKGROUND

1. Field

The disclosed embodiments relate to the field of cutting pills for the purposes of dosing or making pills easier to swallow.

2. Description of the Related Art

It is known to cut pills using various cutting devices. With this sort of device, the pill is rested on a surface (e.g., a rubber pad), which serves as a lower jaw. The pill, when intended for splitting, is nested between two converging angled walls. The two walls extend up from the lower jaw, and aid in centering the pill. A straight-edged blade extends down from an upper jaw that is hingably attached to the lower jaw. When the upper jaw is brought down, the razor cuts the pill. The razor blade is typically a straight razor or anvil-type blade that splits the pills using a crushing force along the sharp point of the blade. Similar to splitting a log with an ax, this method uses pressure to fracture the pill along the sharp edge of the blade. In turn, this impacts the precision of the "split," especially with standard pills which have convex exterior surfaces, often resulting in pill fragments and irregular surfaces where the cut has been made. Consequently, this adversely affects the accuracy of medication dosage.

Some common pill shapes include convex-faced elongated tablets, convex-faced round tablets, and flat-faced round tablets. The diameter and surface curvature of convex tablets may vary. For example, a typical diameter for convex tablets is about 8 mm. A shallow convex tablet may have a radius of curvature of about 13.5 mm, while a standard convex tablet may have a radius of curvature of about 9.5 mm.

SUMMARY

In an embodiment, a cutting device is provided. The cutting device includes a first blade having a first sharp edge aligned in a first direction, and a second blade having a second sharp edge aligned in a second direction, opposite the first direction. The second blade is oriented adjacently in proximity with the first blade so that they may slide closely besides one another. The first sharp edge has a first concavely-curved indent, and the second sharp edge has a second concavely-curved indent aligned opposite the first concavely-curved indent. The first and second concavely-curved indents form an opening between the first sharp edge and the second sharp edge. The opening is adapted to receive a pill for cutting when the first blade is moved in the first direction and the second blade is concurrently moved in the second direction, which effectively splits the pill for precise dosing and reduced waste.

In another embodiment, a pill-cutting device is provided. The pill-cutting device includes an upper blade having a first curved indent and a lower blade positioned beneath the upper blade. The lower blade has a second curved indent aligned with and facing the first curved indent. The first and second curved indents are arranged to form an opening between them. A handle is mechanically coupled with the upper blade for moving the upper blade. A lever is mechanically coupled by a first end to the lower blade, with the lever being arranged for pivoting about a fulcrum. A rod mechanically couples the handle with a second end of the lever, opposite the fulcrum from the first end, such that motion of the handle concurrently moves the lower blade and the upper blade in opposite directions as the lever pivots about the fulcrum.

BRIEF DESCRIPTION OF THE SEVERAL VIEWS OF THE DRAWINGS

Illustrative embodiments are described in detail below with reference to the attached drawing figures, which are incorporated by reference herein and wherein.

Figure 1:
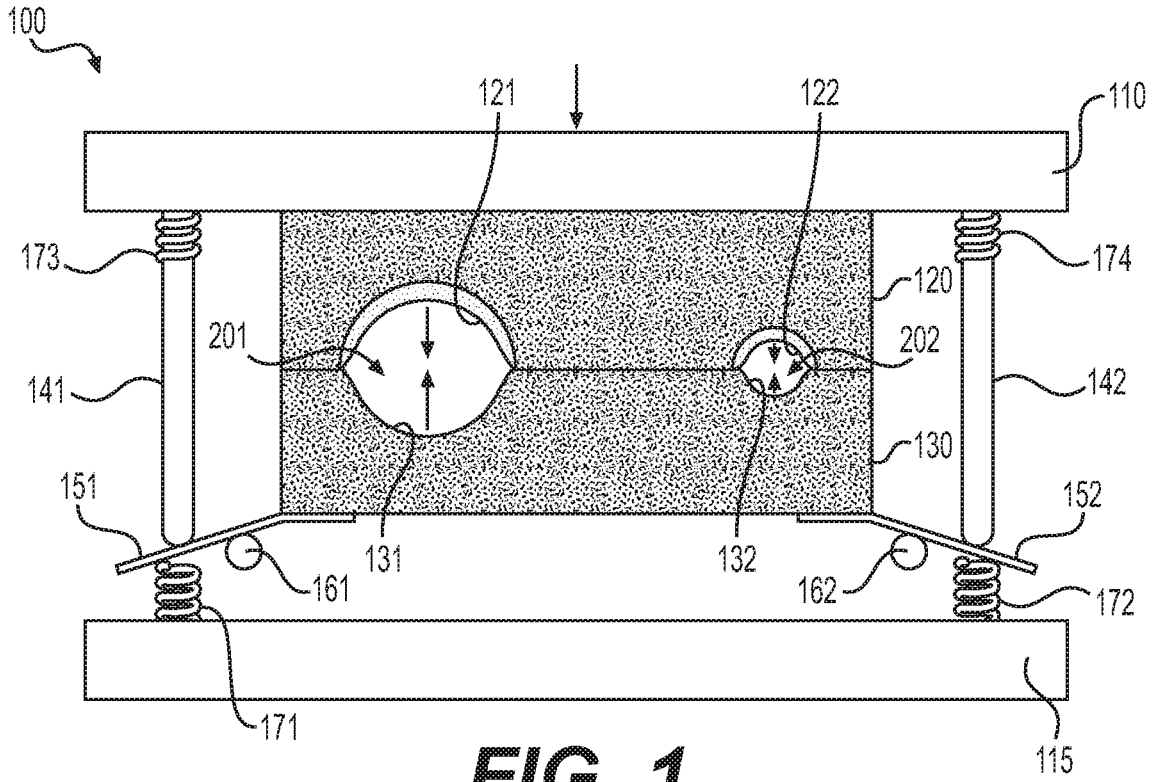
FIG. 1 is a front view of a pill-cutting device, in an embodiment.

The drawing figures do not limit the pill-cutting device to the specific embodiments disclosed and described herein. The drawings are not necessarily to scale, emphasis instead being placed upon clearly illustrating the principles of the pill-cutting device.

DETAILED DESCRIPTION

Embodiments of this disclosure provide systems for cutting pills, including medical tablets, vitamins, supplements, etc. The embodiments involve the use of opposed concave-shaped blades. The blades use compression to both cut and split the pill simultaneously. Embodiments of this disclosure provide a superior, reliable, and more accurate cut without fracturing the pill. Compared to conventional designs that split by breaking the pills, the systems disclosed herein primarily cut, which enables more-precise dosing with less waste. Although useful for numerous pill shapes and types, the disclosed device is ideal for convex-shaped pills which can be very challenging to cut with a straight blade.

In the disclosed embodiment, a pill-cutting device according to this disclosure comprises a pair of concavely-curved sharp blades that are adjacently aligned in opposition with one another. Various embodiments relate to the use of these curved blades in different physical arrangements, some (but not all) of which are described below. The combination of the curved blades and their movement about a fulcrum result in a combined shearing tension and cutting action along a plane formed between the opposed blades. Additionally, a single concavely-curved blade located on either as an upper or lower blade could be used and still meet the objectives of what is disclosed. Thus, the invention should not be limited to any number of blades unless so specified in the claims. Obviously, the pill-cutting device may be used to cut other objects including edible articles, without departing from the scope hereof.

Figure 2:
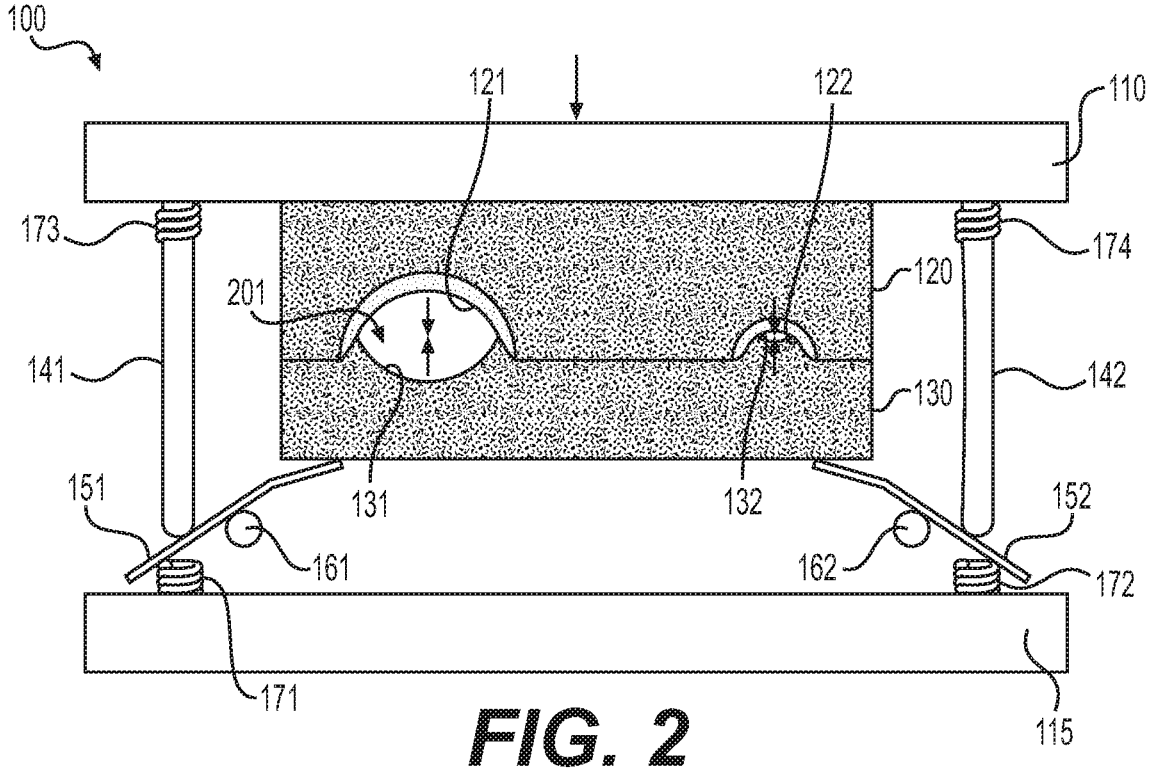
FIG. 2 is a front view of the pill-cutting device of FIG. 1 in a partially-closed position.

FIG. 1 is a front view of a pill-cutting device 100 in an open position. FIG. 2 is a front view of pill-cutting device 100 in a partially-closed position. FIGS. 1 and 2 are best viewed together with the following description. An upper blade 120 is positioned above a lower blade 130. Upper blade 120 and lower blade 130 each include at least one curved indent. For example, upper blade 120 includes a first curved indent 121 and a second curved indent 122. Likewise, lower blade 130 includes a first curved indent 131 and a second curved indent 132. Each curved indent is a concavely-curved portion of the blade that forms an inset along the sharp edge. In certain embodiments, the concavely-curved indent is substantially semi-circular in shape. The curvatures of the indents are adapted to allow pills of various sizes and shapes to be cut effectively. One skilled in the art will recognize that instead of oppositely indented blades, a single indented blade may be used with the opposite side of the pill engaged or held in place by some opposing surface, as discussed above.

As depicted in FIG. 1, each curved indent of upper blade 120 is paired with a matching and opposing curved indent of lower blade 130. The pairs of curved indents face one another forming an opening therebetween. Each opening is adapted for receiving an edible article, such as a pill, to be cut. For example, pill-cutting device 100 includes a first pair of opposing curved indents formed from first curved indent 121 in upper blade 120 that is opposite first curved indent 131 in lower blade 130, which together form a first opening 201. A second pair of opposing curved indents is formed from second curved indent 122 in upper blade 120 that is opposite second curved indent 132 in lower blade 130, which together form a second opening 202. As depicted in FIG. 1, pill-cutting device 100 is in an open position for receiving an appropriately sized pill in one of first opening 201 or second opening 202.

In certain embodiments, the upper and lower blades 120, 130 may include only one opening. However, having more than one opening enables cutting of more than one pill at a time. Additionally, providing differently sized openings enables matching a diameter of an opening with a pill diameter, which may be helpful for cutting otherwise difficult to cut pills (e.g., convex-shaped pills), as further described below in connection with FIG. 12. Pill-cutting device 100, as depicted in FIGS. 1 and 2, includes two pairs of opposing curved indents with each pair forming an opening of a different diameter. A greater or lesser number of opposing curved indents having the same or different diameters may be included in the blades without departing from the scope hereof (e.g., see FIG. 3).

Figure 6:
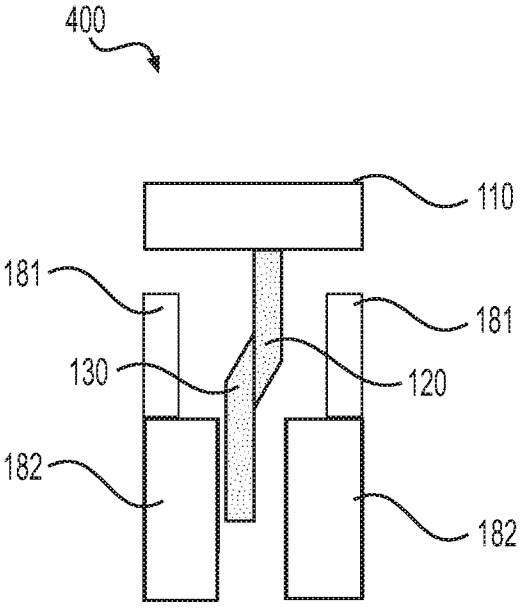
FIG. 6 is a cross-sectional side view of the blades of FIG. 5 in a partially-closed position.
Figure 5:
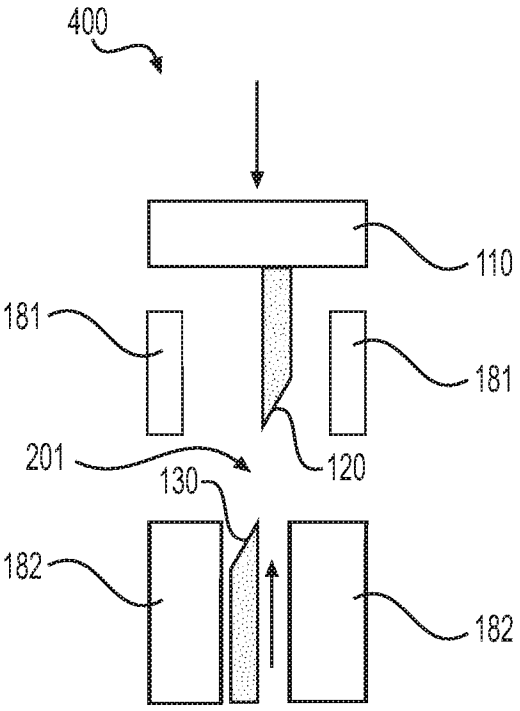
FIG. 5 is a cross-sectional side view of blades of a pill-cutting device, in an embodiment.

Upper blade 120 is aligned adjacent lower blade 130 as best depicted in FIGS. 5 and 6. In the open position, as depicted in FIGS. 1 and 5, upper blade 120 and lower blade 130 overlap slightly outside of the openings 201, 202, which assists with maintaining the blades in alignment with one another for sliding without impediment.

Upper blade 120 is mechanically coupled with a handle 110. When a user presses down on handle 110, this causes upper blade 120 to move downwardly. Concurrently, lower blade 130 moves upwardly via a drive mechanism, such as a rod, lever, and fulcrum arrangement described below. For embodiments without a lower blade, a supporting surface may be used in place of lower blade 130. In certain embodiments, a first blade extends from a first member opposite a second member. The second member may include a supporting surface for holding a pill or a second blade that extends out from the second member opposite the first blade.

As the handle 110 is pressed downwardly, upper and lower blades 120, 130, being aligned adjacent with one another, slide passed each other thereby closing first and second openings 201, 202 either partially or fully, as depicted in FIGS. 2 and 6. Arrows in the figures indicate a direction of travel of the opposing blades while a force is applied to the handle 110.

When a user pushes handle 110, a first rod 141 and a second rod 142 are mechanically coupled with handle 110 such that the rods move in concert with the handle. Each of first rod 141 and second rod 142 engage with a first lever arm 151 and a second lever arm 152, respectively. First lever arm 151 and second lever arm 152 are arranged for pivoting about a first fulcrum 161 and a second fulcrum 162, respectively. As handle 110 moves downwardly, an outer portion of each lever arm is moved downwardly such that the lever arms pivot about their respective fulcrums, causing an inner end of each lever arm to push upwardly on lower blade 130. A first spring 171 and a second spring 172 are attached to a bottom member 115, which may be part of a bottom handle or part of a catch basin for collecting cut pills (see e.g., FIG. 4). As handle 110 moves downwardly, first and second springs 171, 172 are compressed against bottom member 115.

As handle 110 is released, first spring 171 and second spring 172 push upwardly on the outer portion of each lever arm causing the lever arms and lower blade 130 to counter-pivot back to their original position (as depicted in FIG. 1) and causing first rod 141 and second rod 142 to move upwardly, thereby returning handle 110 and upper blade 120 to their original position. Optionally, a third spring 173 and a fourth spring 174 are concentrically arranged around first rod 141 and second rod 142, respectively, beneath handle 110. The third and fourth springs assist with returning handle 110 and upper blade 120 to their uppermost position as further described below in connection with FIG. 4.

In some embodiments, a single rod, lever, and fulcrum arrangement may be used. For example, toward the middle of the blades, a single rod may extend from handle 110 to a single lever that engages an underside of lower blade 130 near its mid-section (between first and second openings 201 and 202).

Figure 3:
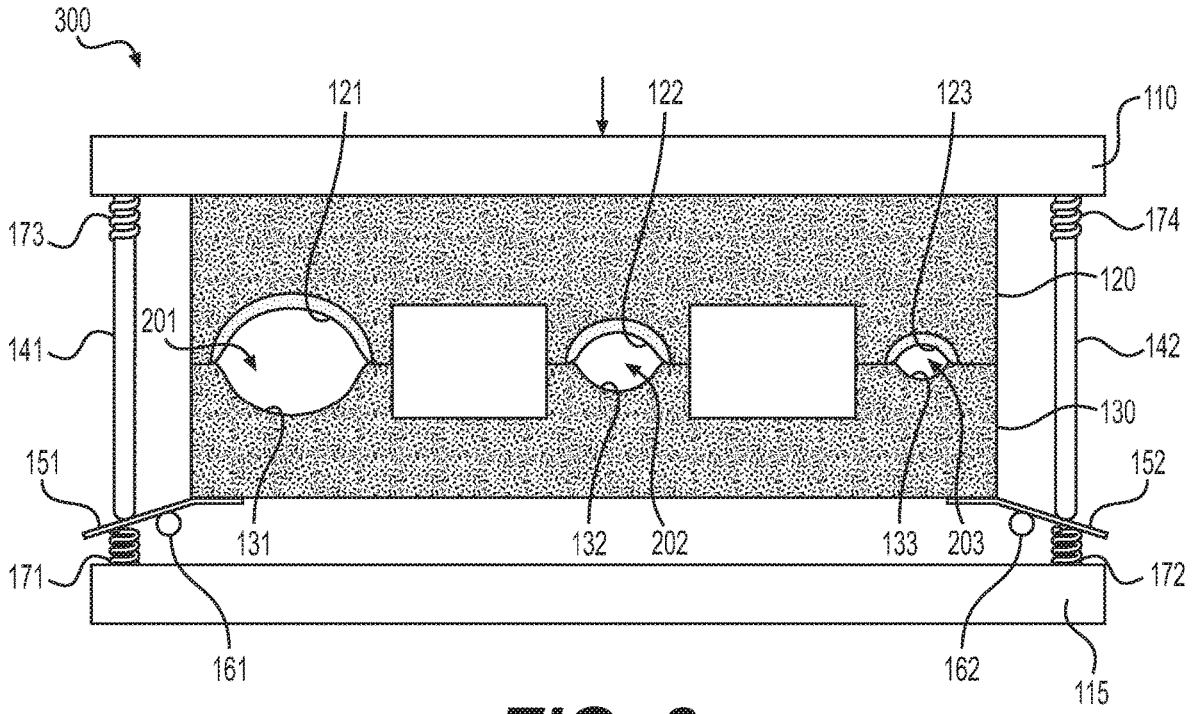
FIG. 3 is a front view of another embodiment of a pill-cutting device.

FIG. 3 is a front view of pill-cutting device 300 in the open position, which is an example of pill-cutting device 100, FIG. 1 that includes three openings having different diameters. Specifically, a third pair of opposing curved indents is formed from a third curved indent 123 in upper blade 120 that is opposite a third curved indent 133 in lower blade 130, which together form a third opening 203. Components enumerated with like numerals are the same or similar and their description may not be repeated accordingly.

Pill-cutting device 300 may be used to cut three pills simultaneously or to optimize cutting of different diameter pills. In the open position, upper blade 120 overlaps slightly with lower blade 130 outside of the curved indents to help keep the blades aligned adjacent to one another (in the manner described above for pill-cutting device 100).

As depicted in FIG. 3, upper and lower blades 120, 130 may optionally include one or more cutouts. For example, first cutouts 125, 135 are located in upper and lower blades 120, 130, respectively, between the first and second openings 201, 202. Second cutouts 126, 136 are located in upper and lower blades 120, 130, respectively, between the second and third openings 202, 203.

Figure 4:
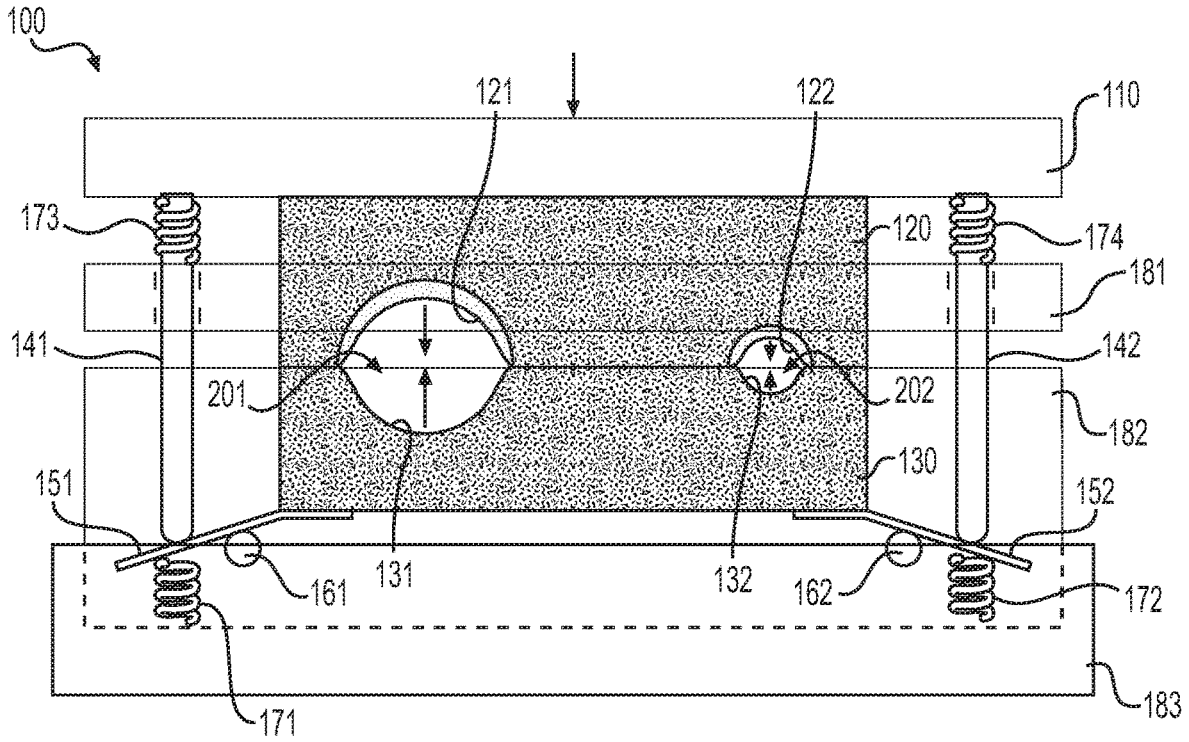
FIG. 4 is a front view of yet another embodiment of a pill-cutting device having a housing.

Any of the embodiments discussed herein (e.g., pill-cutting device 100) may be incorporated into a housing of suitable design and dimensions. FIG. 4, described below, depicts an exemplary housing for a pill-cutting device. The housing is constructed of a suitable material (e.g., a plastic such as polycarbonate) to provide sufficient strength, durability, and health safety. The dimensions and arrangement of the housing components may be varied to accommodate relevant manufacturing and marketing needs. The pill-cutting device is mounted within the housing in a suitably sturdy and functional manner. The housing may help to ensure a stable alignment of the pertinent mechanical parts (e.g., upper and lower blades 120, 130).

FIG. 4 is a front view of a pill-cutting device 400. Pill-cutting device 400 is an example of pill-cutting device 100 having a housing. Namely, pill-cutting device 400 includes an upper housing 181, a lower housing 182, and a catch basin 183. Not all components in FIG. 4 are enumerated for clarity of illustration.

Upper housing 181 includes a first and second through-hole (indicated with dashed lines in FIG. 4) for enabling first and second rods 141, 142 to pass through, respectively. The through-holes enable upper housing 181 to freely slide up and down along first and second rods 141, 142 such that upper housing 181 may rest upon lower housing 182. When upper housing 181 is in contact with lower housing 182, the curved indents of upper and lower blades 120, 130 are concealed and protected such that the sharp edges of the blades are inaccessible for increased safety. Upper housing 181 may be slid upwards along first and second rod 141, 142 to allow access to the curved indents of upper and lower blades 120, 130 and for inserting a pill therebetween. The upper housing 181 may be slid upwards until it compresses optional third and fourth springs 173, 174 with handle 110, or until housing 181 contacts handle 110. In certain embodiments, when handle 110 is fully pressed downwards, upper housing 118 is sandwiched between, and in contact with, both handle 110 and lower housing 182. In other words, housing 181 and housing 182 provide a hard stop for depression of handle 110 as it is moved downwards. Upon release of handle 110, optional third and fourth springs 173, 174 assist with returning handle 110 to its original uppermost position by extending against upper housing 181.

Catch basin 183 provides a floor of the housing and replaces bottom member 115 of pill-cutting device 100, FIG. 1. As handle 110 moves downwardly, first and second springs 171, 172 are compressed against the floor of catch basin 183. Catch basin 183 also provides a receptacle for collecting pill portions following cutting.

FIG. 5 is a cross-sectional side view of exemplary pill-cutting device 400, FIG. 4 in an open position. FIG. 6 is a cross-sectional side view of pill-cutting device 400 in a closed position. The cross-section is taken from about the middle of a pair of opposing curved indents such as that formed from first curved indent 121 in upper blade 120 and first curved indent 131 in lower blade 130, FIG. 1. FIGS. 5 and 6 are best viewed together with the following description.

FIG. 5 shows pill-cutting device 400 in an open position ready to accept a pill for cutting. Opening 201 between upper and lower blades 120 and 130 is adapted for receiving a pill, and upper housing 181 is slid upwards away from lower housing 182 to provide access to opening 201. FIG. 6 shows pill-cutting device 400 in a closed position after handle 110 has been depressed. Upper and lower blades 120 and 130 overlap, and upper housing 181 is slid downwards into contact with lower housing 182, thereby limiting downward movement of handle 110. The gap between upper housing 181 and handle 110 is due to third and fourth springs 173, 174. Lower blade 130 moves independently of lower housing 182 via the drive mechanism described above. FIGS. 5 and 6 show how upper blade 120 and lower blade 130 are aligned adjacent to one another with a slight lateral offset to allow the blades to slide by each other in close proximity as they overlap. In other words, the sharp edges of upper and lower blades 120, 130 do not abut against one another but instead pass by one another.

A cutting plane is a plane through the pill or article to be cut, which is determined at least in part by the plane formed by upper blade 120. In certain embodiments, the cutting plane is aligned between upper blade 120 and lower blade 130. Prior to cutting, a pill is aligned with the cutting plane. For example, a pill may be centered across the cutting plane prior to cutting.

Figure 8:
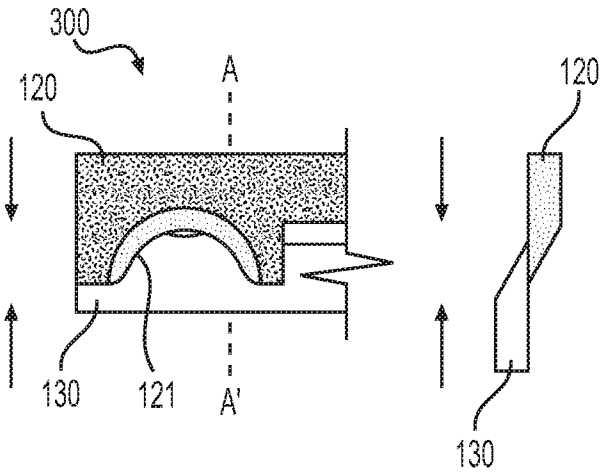
FIG. 8 shows a front view and a cross-sectional side view of the blades of the pill-cutting device of FIG. 7 in a closed position.
Figure 7:
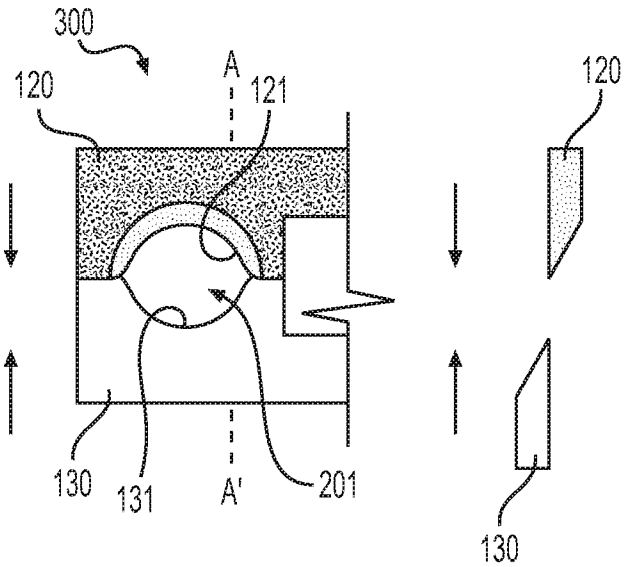
FIG. 7 shows a front view and a cross-sectional side view of the blades of a pill-cutting device in an open position, in an embodiment.

FIG. 7 shows a front view and a cross-sectional side view of the blades of pill-cutting device 300 in an open position. FIG. 8 shows a front view and a cross-sectional side view of the blades of pill-cutting device 300 in a partially-closed position. FIGS. 7 and 8 are best viewed together with the following description. The side views are shown on the right of their respective front views in FIGS. 7 and 8. The location of the cross-section for the side views corresponds with the A-A' line of the front views for each figure. Arrows in FIGS. 7 and 8 demonstrate relative direction of movement of the blades when a force is applied to handle 110. The side views show a relative position of the curved indent of blades 120, 130 in the open position (FIG. 7) and a closed position (FIG. 8).

Figure 10:
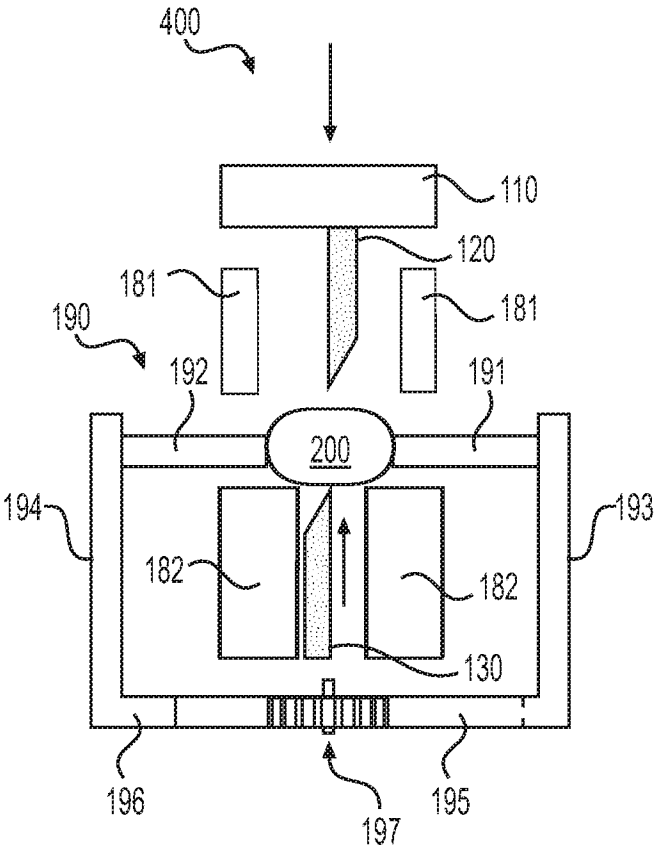
FIG. 10 shows a cross-sectional side view of the pill-cutting device and the pill-centering apparatus of FIG. 9 in a centered position.
Figure 9:
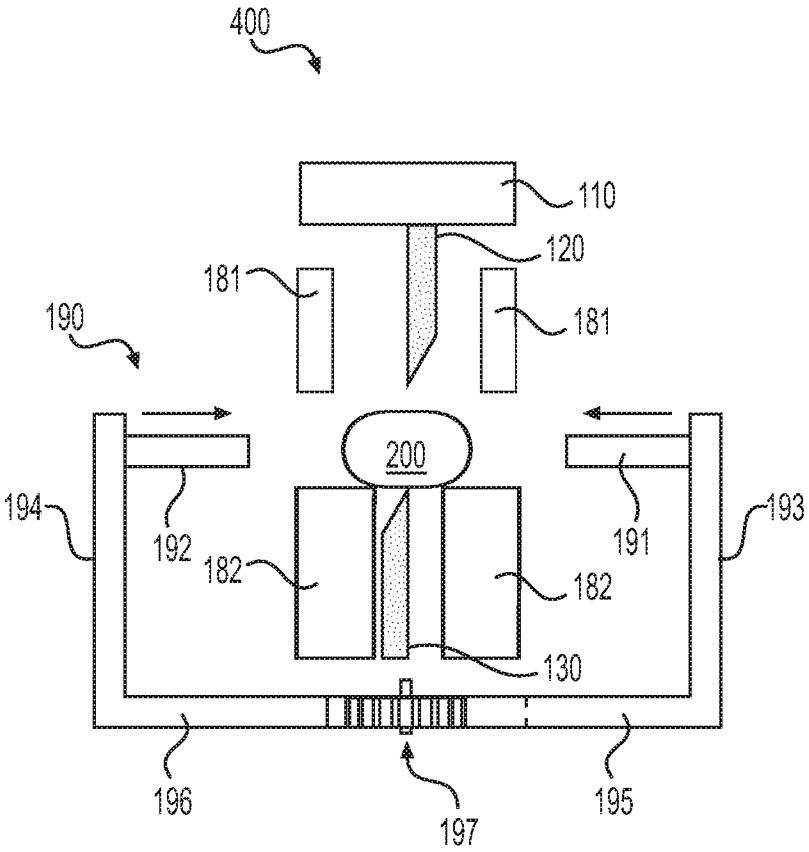
FIG. 9 shows a cross-sectional side view of a pill-cutting device having an optional pill-centering apparatus in a receiving position, in an embodiment.

FIG. 9 shows a cross-sectional side view of pill-cutting device 400 having an optional pill-centering apparatus 190 in a receiving position. FIG. 10 shows a cross-sectional side view of pill-cutting device 400 and optional pill-centering apparatus 190 in a centered position. FIGS. 9 and 10 are best viewed together with the following description.

FIGS. 9 and 10 show pill-centering apparatus 190 for centering a pill 200. Pill 200 is a diagrammed representative medical tablet, for example. As depicted in FIGS. 9 and 10, pill 200 is shaped like a convex-faced elongated tablet. However, pill 200 may have an alternative shape, including but not limited to convex-faced round tablets and flat-faced round tablets.

Prior to cutting, pill 200 is centered using apparatus 190. Arrows in FIG. 9 show the direction of travel of a first arm 191 and a second arm 192 for centering pill 200. Arrows in FIG. 10 show the direction of downward travel of handle 110 and of upward travel of lower blade 130 when a force is applied to handle 110 for cutting pill 200, as described above in connection with FIG. 1.

First and second arms 191, 192 are oriented transversely from upper and lower blades 120, 130. In other words, the length of upper and lower blades 120, 130 are arranged longitudinally and first and second arms 191, 192 are oriented perpendicular to upper and lower blades 120, 130. Each of first arm 191 and second arm 192 are mechanically coupled to a mechanism for moving transversely. For example, as depicted in FIGS. 9 and 10, first and second arms 191, 192 are mechanically coupled to a rack and pinion apparatus via a first vertical bar 193 and a second vertical bar 194, respectively. Each of first vertical bar 193 and second vertical bar 194 are in turn mechanically coupled with first rack 195 and second rack 196, respectively. The racks are arranged transversely and have grooves that interface with a gear 197 (as best viewed in FIG. 11). When one of the racks is moved transversely, the transverse movement is transferred via gear 197 to the other rack in the opposite direction.

Pill-centering apparatus 190 may be activated by pressing inwardly on one or both of arms 191, 192 or components coupled thereto, such as vertical bars 193, 194. Upon activation, pill 200 is automatically moved transversely to a central position such that a midpoint of pill 200 is substantially aligned with a cutting plane between blades 120, 130.

Figure 11:
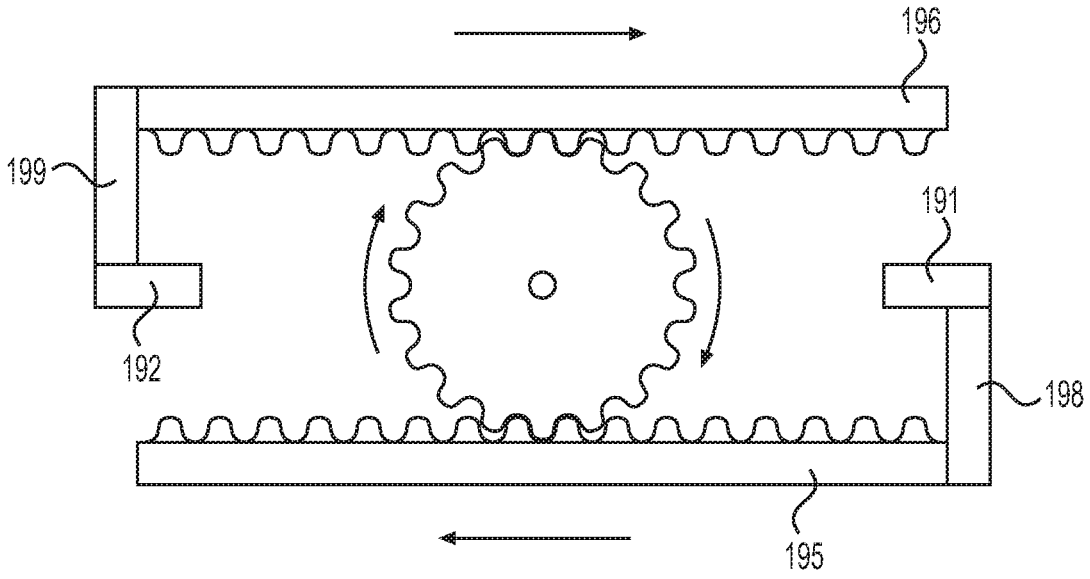
FIG. 11 shows a top-down view of the pill centering apparatus of FIG. 9.

FIG. 11 shows a top-down view of pill centering apparatus 190 of FIG. 9. First rack 195 is aligned substantially in parallel with second rack 196. As either of first or second racks 195, 196 is pushed or pulled, gear 197 rotates causing the racks 195, 196 to move in concert with one another in opposite directions. Arrows in FIG. 11 show direction of racks 195, 196 as the arms 191, 192 move towards one another for centering a pill. A first longitudinal bar 198 and a second longitudinal bar 199 connect first and second vertical bars 193, 194 with first and second arms 191, 192, respectively, thereby centrally aligning first and second arms 191, 192 between first rack 195 and second rack 196.

Figure 12:
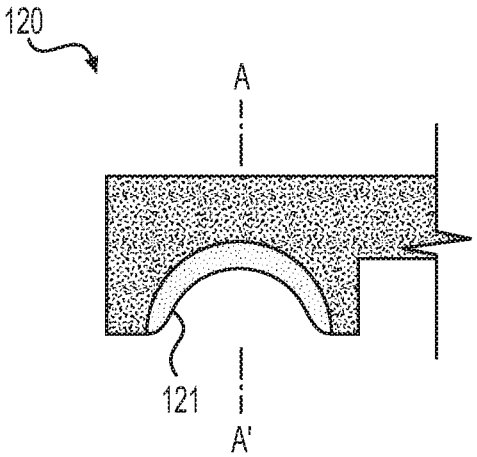
FIG. 12 shows a front view of an upper blade of a pill-cutting device, in an embodiment.

FIG. 12 shows a front view of upper blade 120. In certain embodiments, a diameter and a radius of curvature of curved indent 121 may be formed to be match those of a particular type of pill to be cut, such as a standard convex tablet having a diameter of 8 mm and a radius of curvature of 9.5 mm. In some embodiments, the diameter and/or the radius of curvature of curved indent 121 are larger than that of a standard convex tablet.

Figure 13:
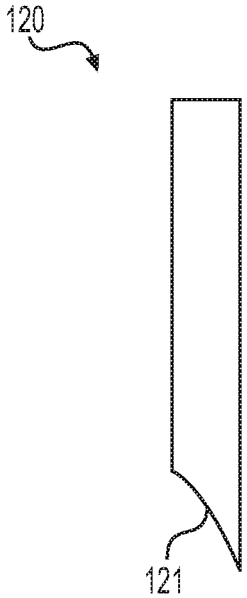
FIG. 13 shows a cross-sectional side view of the upper blade of FIG. 12.

FIG. 13 shows a cross-sectional side view of upper blade 120. FIGS. 12 and 13 are best viewed together with the following description. The location of the cross-section for the side view of FIG. 13 corresponds with the A-A' line of the front view of FIG. 12. Upper blade 120, as depicted in FIGS. 12 and 13, may be used in combination with lower blade 130, as depicted in FIGS. 1-4, for example. Alternatively, upper blade 120, as depicted in FIGS. 12 and 13, may be used without a lower blade, as described above.

FIG. 13 shows the blade coming to a sharp edge. The sharp edge is formed within the curved indent of the blade. As depicted in the cross-sectional view of FIG. 13, the sharp edge may be formed to have a non-linear slope. In other words, the slope of the sharp edge may be non-straight or curved. For embodiments having both upper blade 120 and lower blade 130 (e.g., FIGS. 1-4), the back of the sharp edge of blade 120 is the side that is aligned with, and adjacent to, the back of the opposing lower blade 130, which has the same cross section with the non-linear slope facing the opposite direction.

Many different arrangements of the various components depicted, as well as components not shown, are possible without departing from the spirit and scope of what is claimed herein. Embodiments have been described with the intent to be illustrative rather than restrictive. Alternative embodiments will become apparent to those skilled in the art that do not depart from what is disclosed. A skilled artisan may develop alternative means of implementing the aforementioned improvements without departing from what is claimed.

It will be understood that certain features and subcombinations are of utility and may be employed without reference to other features and subcombinations and are contemplated within the scope of the claims. Not all steps listed in the various figures need be carried out in the specific order described.

What is claimed is:

1. A pill-cutting device, comprising:

an upper blade having a first curved indent;

a lower blade positioned directly beneath the upper blade, the lower blade having a second curved indent and facing the first curved indent to form an opening therebetween;

a cutting plane aligned between the upper blade and the lower blade;

a handle mechanically coupled with the upper blade for translating moving the upper blade directly downward towards the lower blade when the handle is activated;

a lever arrangement mechanically coupled by a first end to the lower blade, the lever being arranged for pivoting about a fulcrum, the lever biasing the upper and lower blades apart prior to an activation; and a rod mechanically coupling the handle with a second end of the lever, opposite the fulcrum from the first end, such that motion of the handle concurrently moves the lower blade and the upper blade in opposite directions as the lever pivots about the fulcrum;

a lower spring supported by a bottom member under the lever and beneath the rod, the lower spring contacting the lever such that the lower spring is compressed when the handle is moved downwardly, and when the handle is released the lower spring extends to counter-pivot the lever about the fulcrum thereby raising the handle relative to the lower blade; and a pill-centering apparatus, the pill-centering apparatus compelling the pill to be centered in the cutting plane from directions lateral to the cutting plane.

2. The pill-cutting device of claim 1, wherein the upper blade is aligned adjacently and in parallel with the lower blade such that a side of the upper blade abuts the lower blade thereby allowing the upper and lower blades to slide by each other in close proximity and as the upper blade moves downwardly and the lower blade moves upwardly.

3. The pill-cutting device of claim 1, wherein the opening between the first curved indent and the second curved indent closes as the upper blade moves downwardly adjacent the lower blade, and as the lower blade concurrently moves relatively upwardly.

4. The pill-cutting device of claim 1, wherein the first curved indent and the second curved indent each have a sharp edge having a non-linear slope, and the sharp edge of the first curved indent faces away from the sharp edge of the second curved indent.

5. The pill-cutting device of claim 1, wherein the upper blade and the lower blade overlap slightly when the handle is released thereby maintaining alignment of the upper and lower blades with one another for sliding without impediment.

6. The pill-cutting device of claim 1, wherein the upper blade and the lower blade each have a plurality of curved indents matched in pairs to form a respective plurality of openings therebetween.

7. The pill-cutting device of claim 6, wherein the plurality of openings are each of a different diameter.

8. The pill-cutting device of claim 1, further comprising a housing having a catch basin that provides a receptacle for collecting portions of a pill following cutting.

9. The pill-cutting device of claim 8, wherein the housing further comprises:

an upper housing that is free to slide upwards and downwards along the rod such that when slid upwards the opening is accessible and when slid downwards the opening is concealed; and a lower housing that conceals the lower blade when the handle is released, wherein the upper housing contacts the lower housing and the handle when the handle is fully depressed.

10. The pill-cutting device of claim 1, further comprising an upper spring arranged concentrically around the rod between the handle and the upper housing, the upper spring adapted to assist with returning the handle and the upper blade to their uppermost position.

11. The pill-cutting device of claim 1, wherein the pill-centering apparatus further comprises:

a first arm oriented transversely from the upper blade and the lower blade;

a second arm oriented transversely from the upper blade and the lower blade opposite the first arm;

a first rack mechanically coupled to the first arm and a second rack mechanically coupled to the second arm, the second rack being aligned in parallel with the first rack; and a gear interposed between the first rack and the second rack such that movement imparted to the first arm drives motion of the second arm in an opposite direction to bear against lateral extremities of the pill relative to the cutting plane.

12. The pill-cutting device of claim 11, wherein the first arm and the second arm are centered about the opening such that a cutting plane of the upper blade and the lower blade aligns with a midpoint of a pill.

13. A pill-cutting device, comprising:

a first member and an opposed second member;

a blade configured to receive a pill surface in a concavely-curved area recessed into a leading edge of the blade, the blade extending out from the first member;

a drive mechanism for converging the curved blade along a cutting plane towards the second member;

a pair of opposed rods each having a first end and a second end, the first ends being mechanically coupled to the drive mechanism;

a pair of levers mechanically coupled with each of the second ends of the rods respectively, the pair of levers being pivotally coupled with the blade via a pair of fulcrums respectively such that the blade moves in concert with the drive mechanism;

springs supported by a bottom member beneath the levers such that the springs are compressed between the levers and the bottom member when the drive mechanism is pushed, and upon release of the drive mechanism, the springs extend to automatically return the drive mechanism; and a pill-positioning apparatus, the pill-positioning apparatus, prior to activation of the drive mechanism, centering a pill across the cutting plane.

14. The pill-cutting device of claim 13, wherein a second curved blade extends out towards the first blade from the second member when a cut is made.

15. A pill cutter device, comprising:

a first blade and a second blade, an abutment surface of the first blade configured to and be linearly translated along an opposing abutment surface of the second blade; cutting edges of the first blade and second blade, the cutting edges defined along the abutment surfaces of the first blade and the second blade, the cutting edges establishing a cutting plane parallel with the inside surfaces of each of the first and second blades;

the first cutting edge having a first concave indent;

the second cutting edge having a second concave indent centered below the first concave indent enabling the receipt of a pill in an opening defined between the first and second indents;

a rod having a first end and a second end opposite the first end, the rod being mechanically coupled by the first end with a handle for moving in concert with the handle;

a lever mechanically coupled with the second end of the rod, the lever being pivotally coupled with the second blade via a fulcrum such that the second blade moves oppositely the first blade in concert with the handle;

a spring attached to a bottom member beneath the lever such that the spring is compressed between the lever and the bottom member when the handle is pushed, and upon release of the handle, the spring extends to automatically return the handle;

an alignment system including a pill-centering mechanism, the pill-centering mechanism securing the pill from sides perpendicular to the cutting plane;

the first and second indents configured to together accommodate the cutting of a top and a bottom of a pill, respectively; and the opening being adapted to receive a pill for cutting when the first blade is translated towards the second blade.

16. The pill cutter device of claim 15, further comprising a the handle mechanically coupled with the first blade for enabling a user to move the first blade towards the second blade.

17. The pill cutter device of claim 15, further comprising a plurality of openings formed between the blades by a plurality of respective pairs of concavely-curved indents, the plurality of openings enabling more than one pill to be cut at a time.

18. The pill cutter device of claim 17, wherein the plurality of openings have a respective plurality of different diameters thereby allowing pills of various sizes to be cut effectively.

* * * * *